US006536557B2

(12) United States Patent
Gibson et al.

(10) Patent No.: US 6,536,557 B2
(45) Date of Patent: Mar. 25, 2003

(54) UTILITY TRAY FOR STEP STOOL

(75) Inventors: William R. Gibson, Kent, OH (US); Enrique R. Giner, Beverly Hills, MI (US)

(73) Assignee: Cosco Management, Inc., Wilmington, DE (US)

( * ) Notice: Subject to any disclaimer, the term of this patent is extended or adjusted under 35 U.S.C. 154(b) by 0 days.

(21) Appl. No.: 09/935,813

(22) Filed: Aug. 23, 2001

(65) Prior Publication Data

US 2003/0029676 A1 Feb. 13, 2003

Related U.S. Application Data

(63) Continuation of application No. 09/927,019, filed on Aug. 9, 2001.

(51) Int. Cl.[7] ..... E06C 1/00; E04G 1/00

(52) U.S. Cl. ..... 182/161; 182/129

(58) Field of Search ..... 182/161, 165, 182/129, 25, 120; D25/65; 292/128, 101, 102, 103, 228, 202, 203, 204; 108/115; 248/210, 238; 206/372, 373

(56) References Cited

U.S. PATENT DOCUMENTS

| | | | | |
|---|---|---|---|---|
| 162,075 A | | 4/1875 | Isaacs et al. | |
| 1,702,249 A | | 2/1929 | Davidson | |
| 2,109,886 A | | 3/1938 | Lewis | |
| 2,207,923 A | | 7/1940 | Kelso | |
| 2,280,691 A | | 4/1942 | Edelmann | |
| 2,525,104 A | | 10/1950 | Cyr | |
| 2,596,521 A | | 5/1952 | Bell | |
| 2,805,104 A | | 9/1957 | Johnson | |
| 2,899,011 A | | 8/1959 | Babits | |
| 3,224,530 A | | 12/1965 | King et al. | |
| 3,842,936 A | * | 10/1974 | De Luca | 182/129 |
| 3,999,629 A | | 12/1976 | Schaffer et al. | |
| 4,440,264 A | | 4/1984 | Knoke et al. | |
| 4,485,892 A | | 12/1984 | Maloney et al. | |
| 4,494,626 A | | 1/1985 | Ast | |
| 4,502,564 A | | 3/1985 | Kümmerlin et al. | |
| 5,386,907 A | * | 2/1995 | Kahl et al. | 206/372 X |
| 5,419,409 A | | 5/1995 | Corulla | |
| 5,438,938 A | * | 8/1995 | Meeker et al. | 108/91 |
| 5,547,080 A | * | 8/1996 | Klimas | 206/373 |
| 5,603,405 A | * | 2/1997 | Smith | 206/373 |
| 5,722,507 A | | 3/1998 | Kain | |
| 5,727,649 A | * | 3/1998 | Buckley | 182/129 |
| 5,740,883 A | * | 4/1998 | Trank | 182/129 |

(List continued on next page.)

FOREIGN PATENT DOCUMENTS

WO WO 00/40824 7/2000

OTHER PUBLICATIONS

11–135 Two Step™ Folding Step Stool, Cosco® A Dorel Company, Home Furnishings, 1996, p. 17.
11–302 Big Step™ Folding Step Stool and 11–307 Deluxe Big Step™ Folding Step/Stool Chair, Cosco® A Dorel Company, Home Furnishings, 1996, p. 18.
11–007 World's Greatest ™Step Stool, Cosco® A Dorel Company, Step Stools, Ladders, 2001, p. 8.

*Primary Examiner*—Daniel P. Stodola
*Assistant Examiner*—Hugh B. Thompson
(74) *Attorney, Agent, or Firm*—Barnes & Thornburg

(57) ABSTRACT

A step stool includes a frame having legs movable relative to each other between an opened use position and a collapsed storage position. The frame includes an upper portion and a lower portion. A tray assembly is provided having a fixed tray mounted to the upper portion and a movable tray coupled to the fixed tray for movement relative to the fixed tray, the movable tray having an opened use position and a closed storage position.

35 Claims, 8 Drawing Sheets

U.S. PATENT DOCUMENTS 5,762,163 A 6/1998 Kain
5,788,072 A * 8/1998 Chen ..... 206/372
5,826,719 A * 10/1998 Chen ..... 206/373
5,873,463 A * 2/1999 Purcell ..... 206/372
5,913,380 A * 6/1999 Gugel et al. ..... 182/129
5,937,968 A 8/1999 Gibson et al.
5,967,260 A 10/1999 Spak
5,971,102 A * 10/1999 Brown ..... 182/129
6,000,497 A * 12/1999 Kain et al. ..... 182/129
6,024,412 A * 2/2000 Kain et al. ..... 297/467
6,026,933 A 2/2000 King et al.
6,341,666 B1 * 1/2002 Allen ..... 182/129

* cited by examiner

UTILITY TRAY FOR STEP STOOL

CROSS-REFERENCE TO RELATED APPLICATIONS

This application is a continuation of U.S. patent application No. 09/927,019, filed Aug. 9, 2001.

BACKGROUND AND SUMMARY OF THE INVENTION

The present invention relates to a step stool, and particularly to a folding step stool including legs that fold between an opened use position and a collapsed storage position. More particularly, the present invention relates to a tray assembly used for storing or holding articles associated with the use of the step stool.

Step stools have a frame and one or more steps that individuals use for elevation when reaching for objects, painting walls, or any everyday task where extra elevation would be helpful. Step stool frames are often foldable for ease of storage while the step stool is not being used. Additionally, a tray assembly may be included to facilitate holding items.

According to the disclosure, a step stool includes a frame having legs movable relative to each other between an opened use position and a collapsed storage position. The frame includes an upper portion and a lower portion. A step is coupled to the lower portion. A tray assembly is provided having a fixed tray mounted to the upper portion and a movable tray coupled to the fixed tray for movement relative to the fixed tray, the movable tray having an opened use position and a closed storage position.

In the illustrative embodiment, at least one drawer is coupled to the tray. The drawer pivots between a closed position and an opened position, and has a stopper to prevent overextension of the drawer. Finger grooves are provided in the tray assembly for facilitating ascension and descension of a user.

Additional features of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
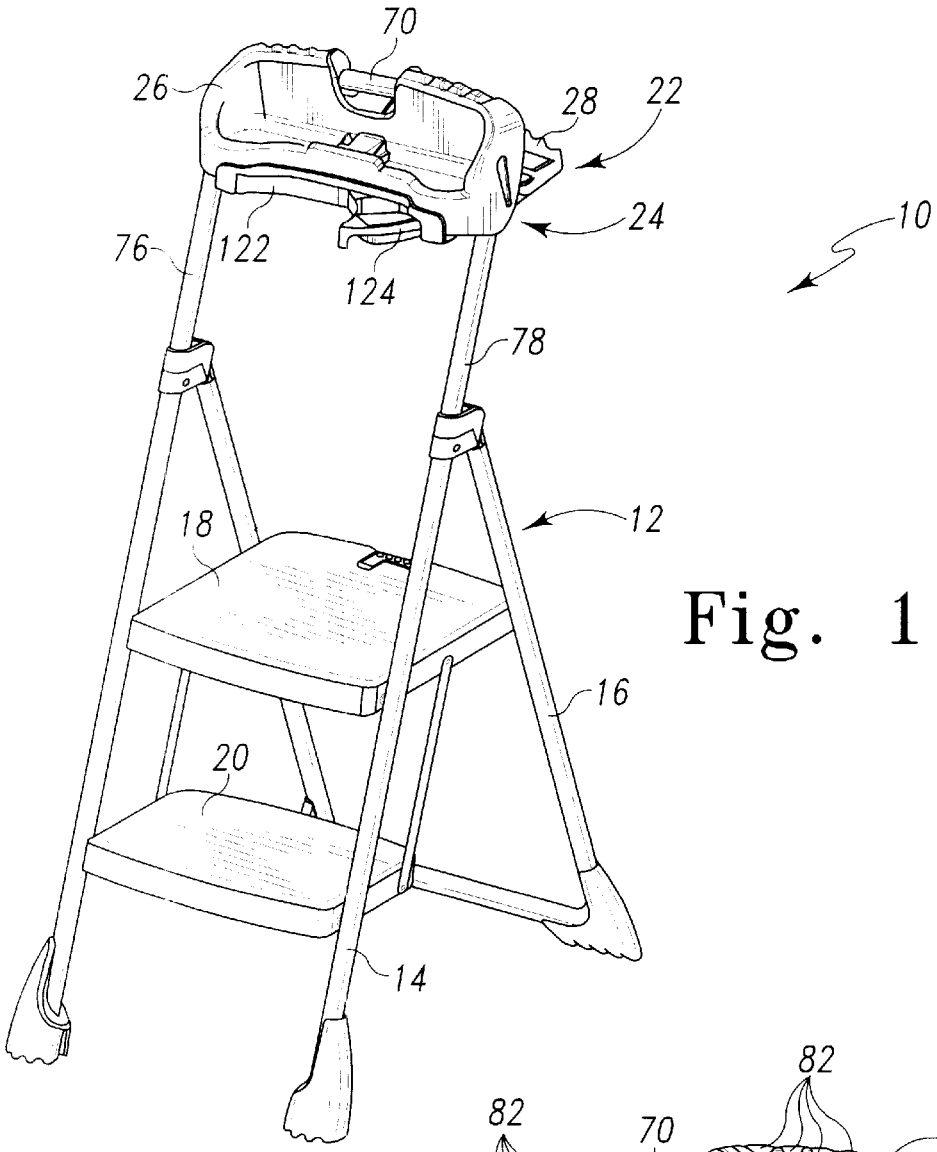
FIG. 1 is a perspective view of a step stool including a front leg, a rear leg coupled to the front leg in an opened use position, and a tray assembly coupled to an upper portion of the step stool frame.

A foldable step stool 10 includes a frame 12 having a front leg 14, a rear leg 16, a top step 18, and illustratively a bottom step 20. Step stool 10 further includes a tray assembly 22 mounted on an upper portion 24 of frame 12, as shown in FIGS. 1–5. Tray assembly 22 includes a fixed tray 26 coupled to upper portion 24 of frame 12, and a movable tray 28 coupled to fixed tray 26 for pivotable movement relative to fixed tray 26.

Figure 2:
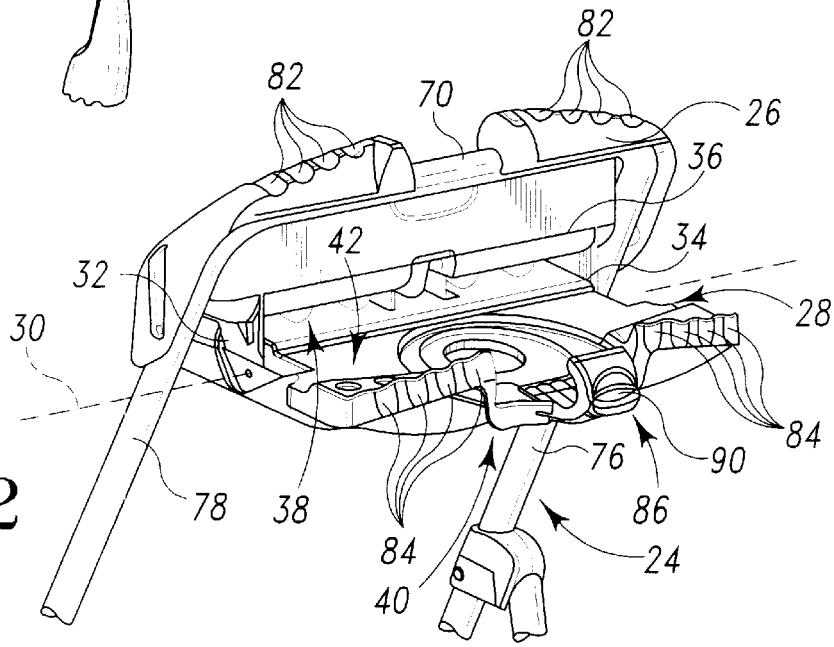
FIG. 2 is a rear perspective view of the upper portion of the step stool of FIG. 1, showing the tray assembly including the fixed tray coupled to the upper portion of the step stool frame and the movable tray coupled for pivoting movement relative to the fixed tray.
Figure 3:
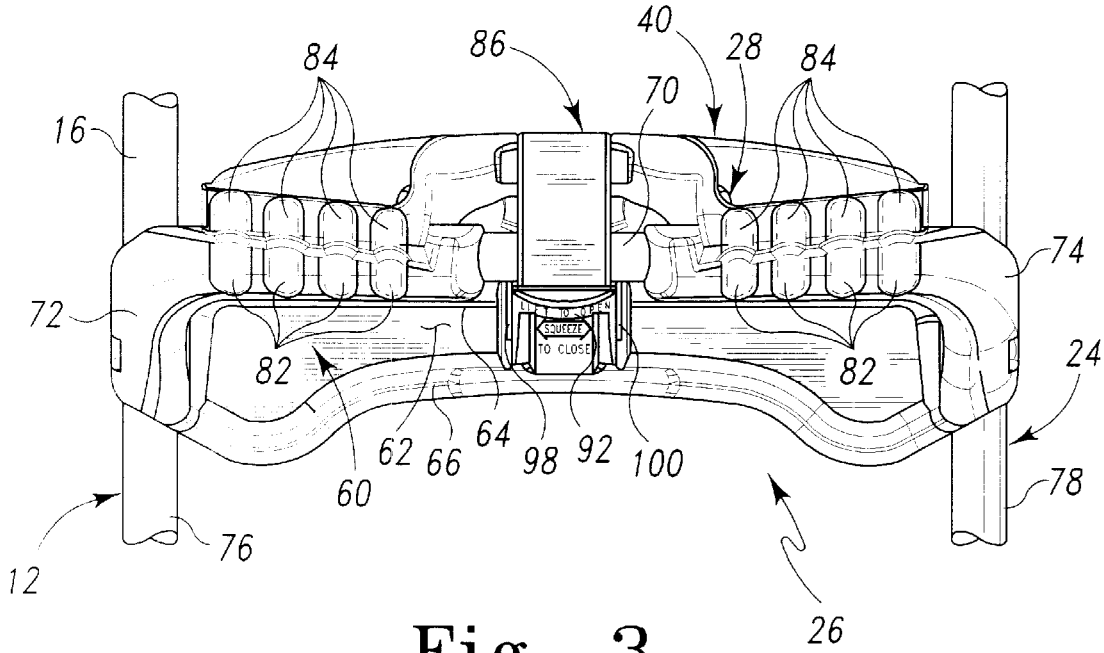
FIG. 3 is a top view of the opened step stool of FIG. 1 showing the movable tray clasped in the vertical, closed position adjacent the fixed tray.
Figure 4:
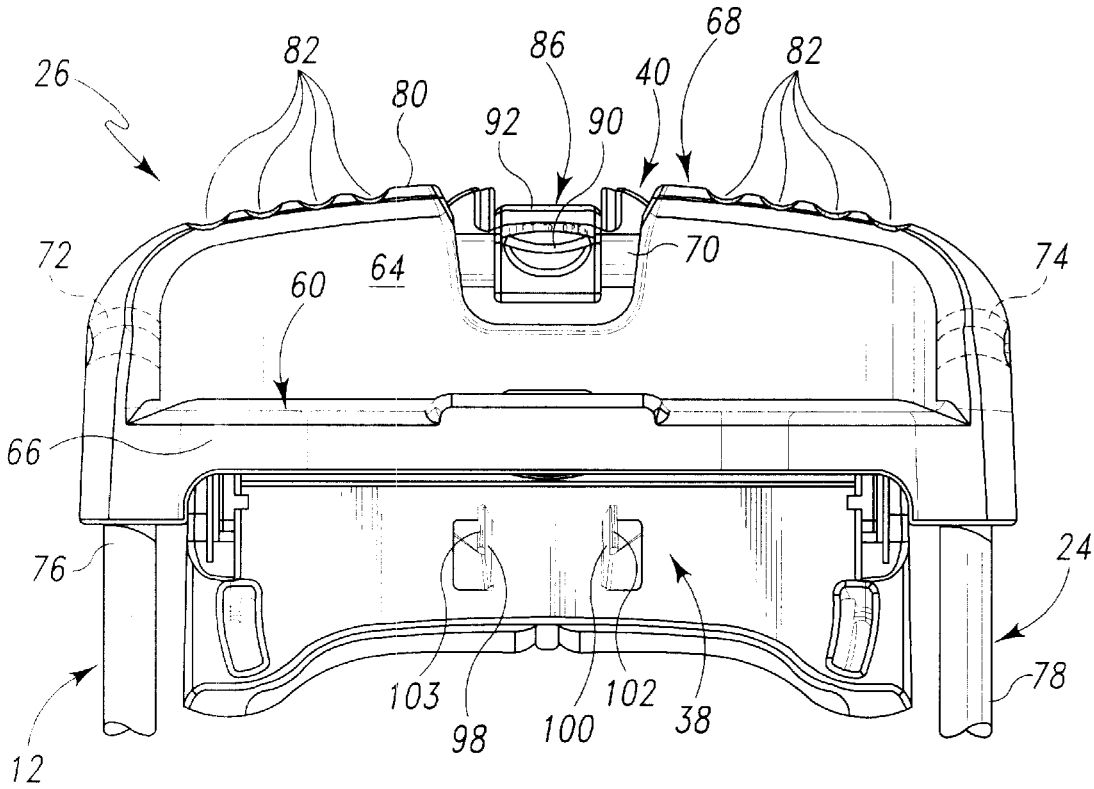
FIG. 4 is a front elevation view of the upper portion of the step stool of FIG. 3, showing the fixed tray having a vertically extending transverse wall disposed between left and right frame members, and showing a portion of the top surface of the movable tray when it is clasped in the vertical, closed position.
Figure 9:
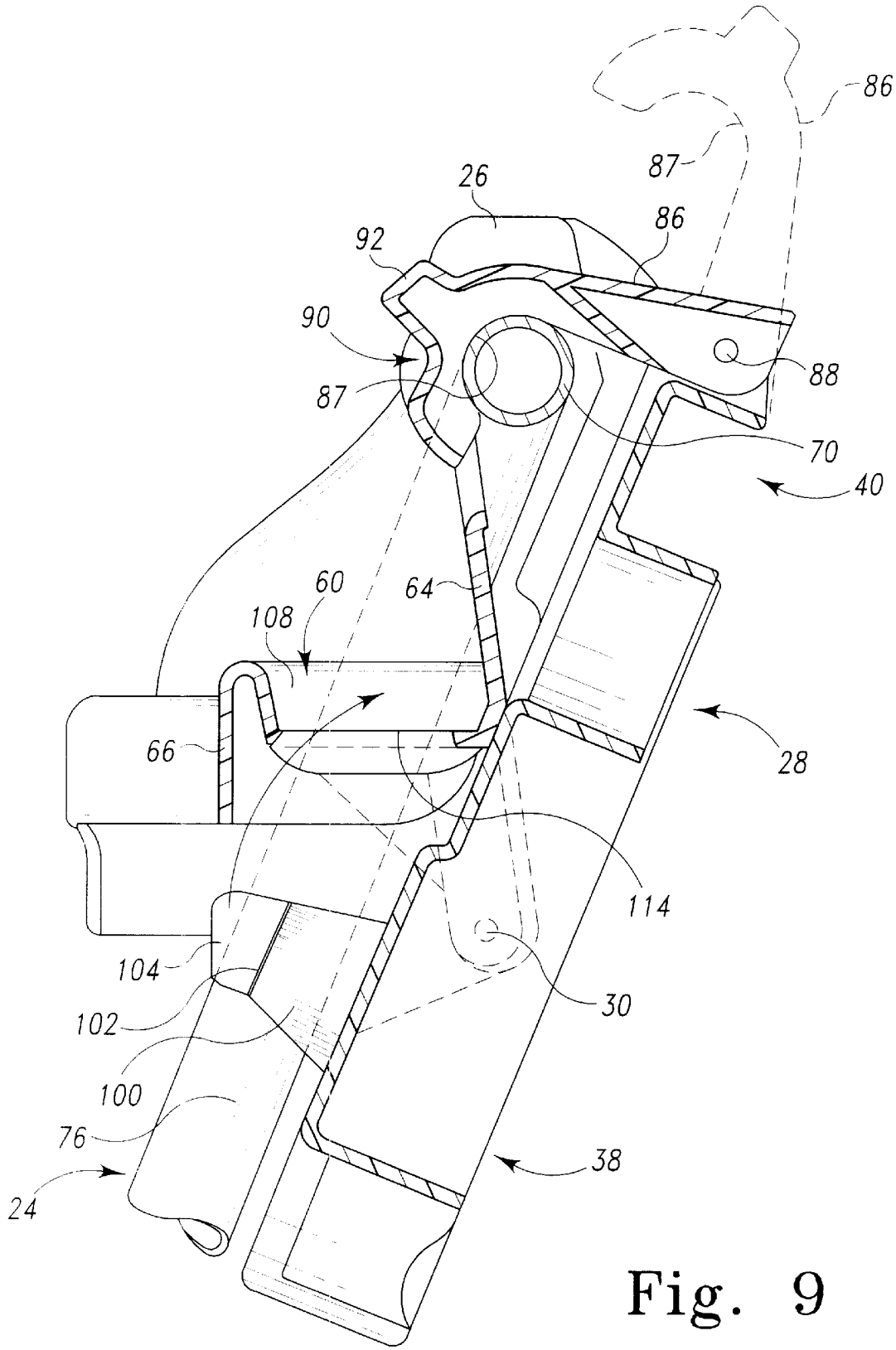
FIG. 9 is a sectional view taken along line 9—9 of FIG. 4, showing the movable tray in its closed position, clasped to a tubular frame member, and showing the clasp in broken lines in the non-clasped position, thereby readying the movable tray to be moved to an opened, use position.
Figures 10, 11:
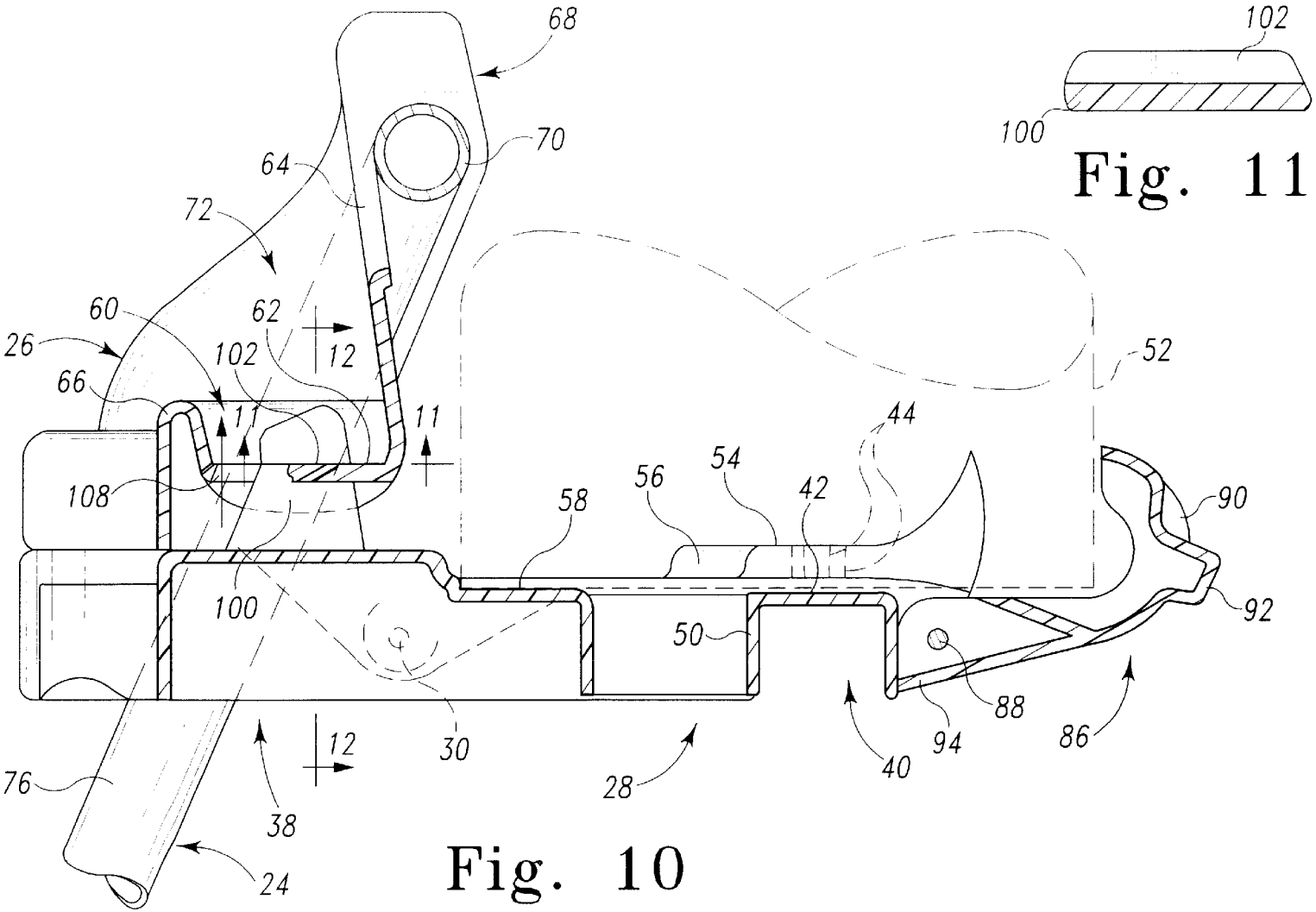
FIG. 10 is a sectional view taken along the line 10—10 of FIG. 5, showing the movable tray in the opened, use position and showing the clasp assisting in the support of a can of paint (shown in phantom), and also showing the lock with portions broken away, the lock being configured to hold the movable tray in the opened position.
FIG. 11 is a sectional view taken along the line 11—11 of FIG. 10, showing the lip formed in one of the tabs of the lock, the lip engaging an edge formed in the fixed tray.

Movable tray 28 has an opened, use position as illustrated in FIGS. 1, 2, 5, 6, and 10, and a closed, storage position as illustrated in FIGS. 3, 4, and 9. In the use position, movable tray 28 extends substantially horizontally from fixed tray 26, as shown in FIGS. 1, 2, and 10. Movable tray 28 is coupled to fixed tray 26 for pivoting movement about axis 30, as shown in FIG. 2. Axis 30 passes through arms 32, 34, which are formed to extend from a rear surface 36 of fixed tray 26.

As movable tray 28 pivots about axis 30 from a storage position shown in FIGS. 4 and 9 to a use position as shown in FIGS. 2 and 10, a mounting or foundation portion 38 of movable tray 28 engages fixed tray 26, while a distal or tray portion 40 of movable tray 28 rotates about axis 30 to a position away from fixed tray 26, such that upper or top surface 42 of movable tray 28 extends substantially horizontally from fixed tray 26.

Fixed tray 26 is a shell that is formed to fit over upper portion 24 of frame 12 such that top portion 68 of fixed tray 26 engages upper transverse cross member 70 of upper portion 24 of frame 12 and is coupled to the frame to lie in a fixed or stationary position, as shown in FIGS. 3–5 and 10. Additionally, fixed tray 26 includes side portions 72, 74 that engage side members or legs 76, 78, respectively, of upper portion 24 of frame 12. Fixed tray 26 is formed to include a shelf having a basin 60 having an upper surface 62, a rear wall 64, and a front rim 66, as can be seen in FIGS. 3–5 and 10. As shown, for example, in FIGS. 1 and 3, basin 60 includes a left-side basin near side member 76 and a right-side basin near side member 78.

Figure 5:
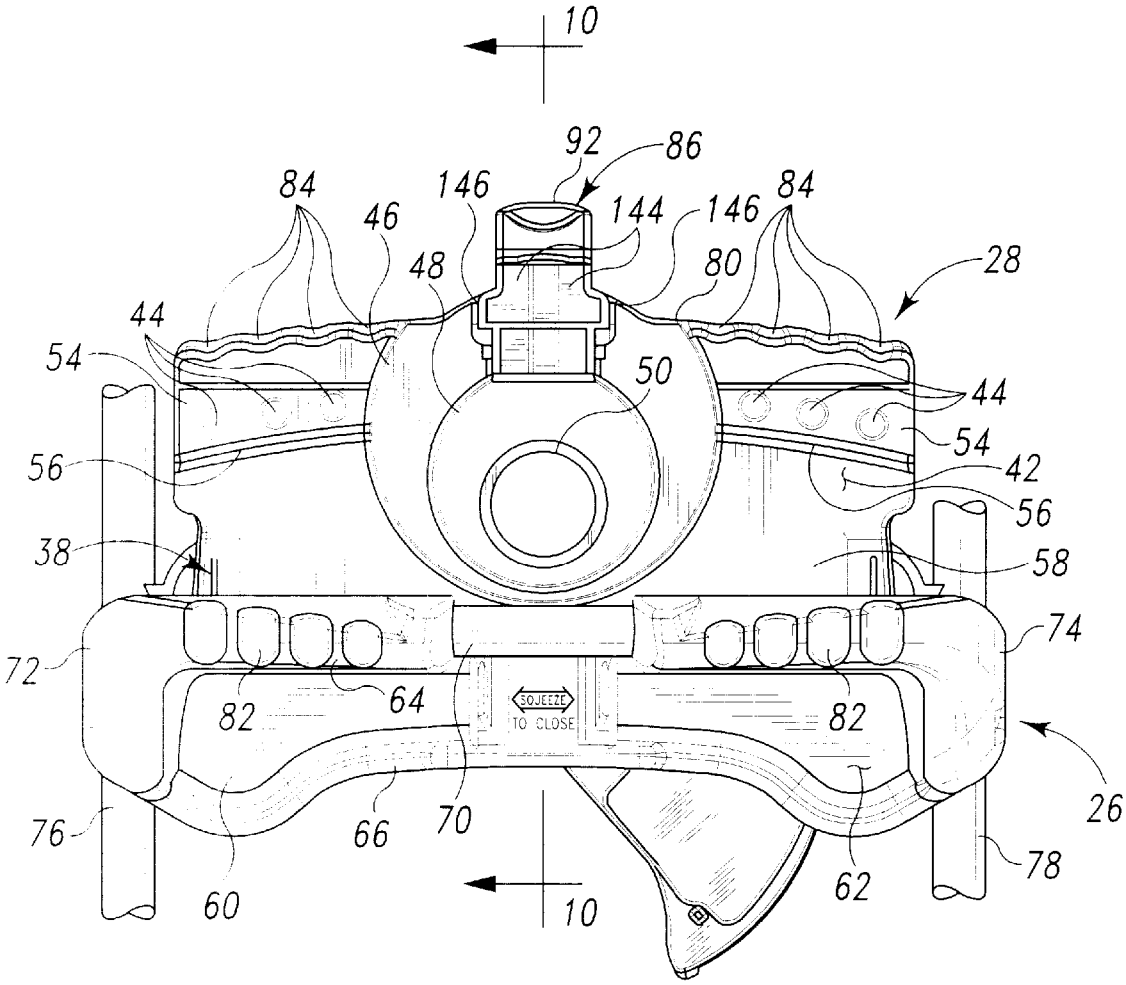
FIG. 5 is a top view of the tray assembly similar to that shown in FIG. 3, except that the movable tray has been unclasped from the vertical, closed position and pivoted to the opened, use position.

Movable tray 28 is formed to include apertures 44, as best seen from the top view of movable tray 28 in FIG. 5. Apertures 44 permit tools, such as screwdrivers, to be hung by their handles (not shown) from the apertures 44 and supported by upper surface 42 of movable tray 28. Apertures 44 are formed in the raised platform portion 54 of upper surface 42, as shown in FIGS. 5 and 10. Raised platform portion 54 includes an inner wall 56 which is formed to be slightly arcuate.

A lowered portion 58 of upper surface 42 is defined between inner walls 56 and mounting portion 38 of movable tray 28, as shown in FIG. 5. Lowered portion 58 of upper surface 42 includes receptors 46, 48, 50 for receiving and positioning, for example, the bottom rim of a can of paint 52 (shown in phantom in FIG. 11). Illustratively, receptors 46, 48 are indentions formed in upper surface 42 of movable tray 28, as shown in FIG. 5. Receptor 50 is a walled cylindrical aperture formed in movable tray 28, as seen from the side in FIG. 10.

Fixed tray 26 is formed to fit over upper portion 24 of frame 12 such that top portion 68 of fixed tray 26 engages upper transverse cross member 70 of frame 12, as shown in FIGS. 3–5 and 10. Additionally, fixed tray 26 includes side portions 72, 74 that engage side members 76, 78, respectively, of frame 12. Fixed tray 26 is formed to include a basin 60 having an upper surface 62, a rear wall 64, and a front rim 66, as can be seen in FIGS. 3–5 and 10.

Top edge 80 of fixed tray 26 is formed to include finger grooves 82, as shown in FIGS. 4 and 5. Movable tray 28 also includes finger grooves 84, which are formed to align with finger grooves 82 when movable tray 28 is in the closed storage position adjacent fixed tray 26, as shown in FIG. 3. Finger grooves 82, 84 provide a convenient and comfortable position for a user to hold when ascending and descending step stool 10.

Movable tray 28 is moved and operated in substantially the following manner. Movable tray 28 is held in the closed storage position adjacent fixed tray 26 with a clasp 86, which is illustratively coupled to movable tray 28. It is within the scope of the disclosure, however, to have other means for holding movable tray 28 in the closed position, and it is similarly within the scope of the disclosure to couple such means to the fixed tray 26 or to the frame 12. In the illustrated embodiment, clasp 86 is configured to pivot about axis 88, shown in FIG. 10. Clasp 86 is formed to include a notch 90 for receiving the finger of an operator, thereby facilitating movement of the clasp 86. A tab 92 is formed adjacent notch 90, also facilitating movement of the clasp 86.

When movable tray 28 is in the closed storage position, clasp 86 is pivotable between an engaged position, shown in FIG. 9, and a disengaged position, shown in phantom in FIG. 9. In the engaged position, clasp 86 is formed to engage upper transverse hook cross member 70, thereby retaining movable tray 28 in the closed position. Clasp 86 is formed to include a frame receiver 87 (as suggested in FIG. 9) configured to receive a portion of the transverse cross member 70 of the frame therein to retain movable tray 28 in the closed position. When clasp 86 is disengaged from cross member 70, movable tray 28 is freely movable between the closed storage portion and the opened use position.

In the opened use position, as shown in FIGS. 5 and 11, clasp 86 is pivotable to a support position, where it is prevented from further pivoting movement by back edge 94 and tabs 144 of clasp 86 contacting movable tray 28. As can be seen in FIG. 5, tabs or tray movers 144 fit in recesses or mover receiver portions 146 of movable tray 28 when clasp 86 is pivoted to the support position. Tray movers 144 engage mover receiver portions 146 as suggested in FIGS. 9 and 10 during pivotable movement of clasp 86 about pivot axis 88 and relative to movable tray 28 to provide handle means for moving the movable tray 28 from the stage position shown in FIG. 9 to the use position shown in FIG. 10. In the support position shown in FIG. 10, clasp 86 is configured to cooperate with upper horizontal surface 42 of movable tray 28 to support items on the movable tray 28, for example, a paint can 52 (shown in phantom).

Figure 12:
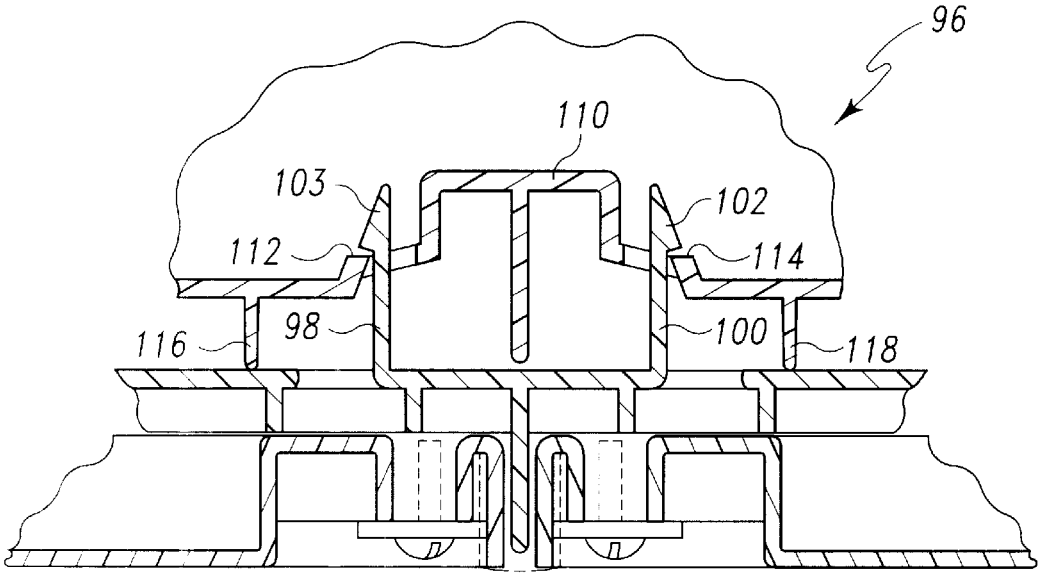
FIG. 12 is a sectional view of the lock taken along the line 12—12 of FIG. 10, showing tabs engaged with edges formed in the fixed tray.

Movable tray 28 is locked in the use position shown in FIG. 10 with a lock 96, which removably secures mounting portion 38 of movable tray 28 to fixed tray 26 in the following manner. Lock 96 illustratively includes a set of two lock tabs 98, 100, each of which is formed to include a lip 103, 102 on a distal end 104 of the tab, as shown in FIGS. 3, 4, and 9–14. Illustratively, tabs 98, 100 with integral lips 103, 102 are configured to pass through slots or tab receivers 106, 108 formed in basin 60 of fixed tray 26, as can be best seen in FIG. 14. A central island 110 is molded in basin 60 of fixed tray 26 between slots 106, 108. As tabs 98, 100 approach slots 106, 108, as shown in FIGS. 4 and 14, lips 103, 102, engage rims 112, 114 of slots 106, 108, respectively, to lock the movable tray 28 in the use position, such that the lock 96 appears as shown in FIG. 12. It should be understood, however, that lock 96 could alternately comprise any other means known in the art for maintaining the movable tray 28 in the opened use position.

As lock tabs 98, 100 approach the engaged position shown in FIG. 12, ribs 116, 118 (in cooperation with other elements of fixed tray 26 and movable tray 28) prevent the over-insertion of tabs 98, 100 into slots 106, 108. Movable tray 28 becomes "locked" in the use position when lips 103, 102 pass rims 112, 114 of slots 106, 108, and move (from pressure provided by the formed tabs 98, 100 returning to their natural position) over the tops of rims 112 114.

Figure 13:
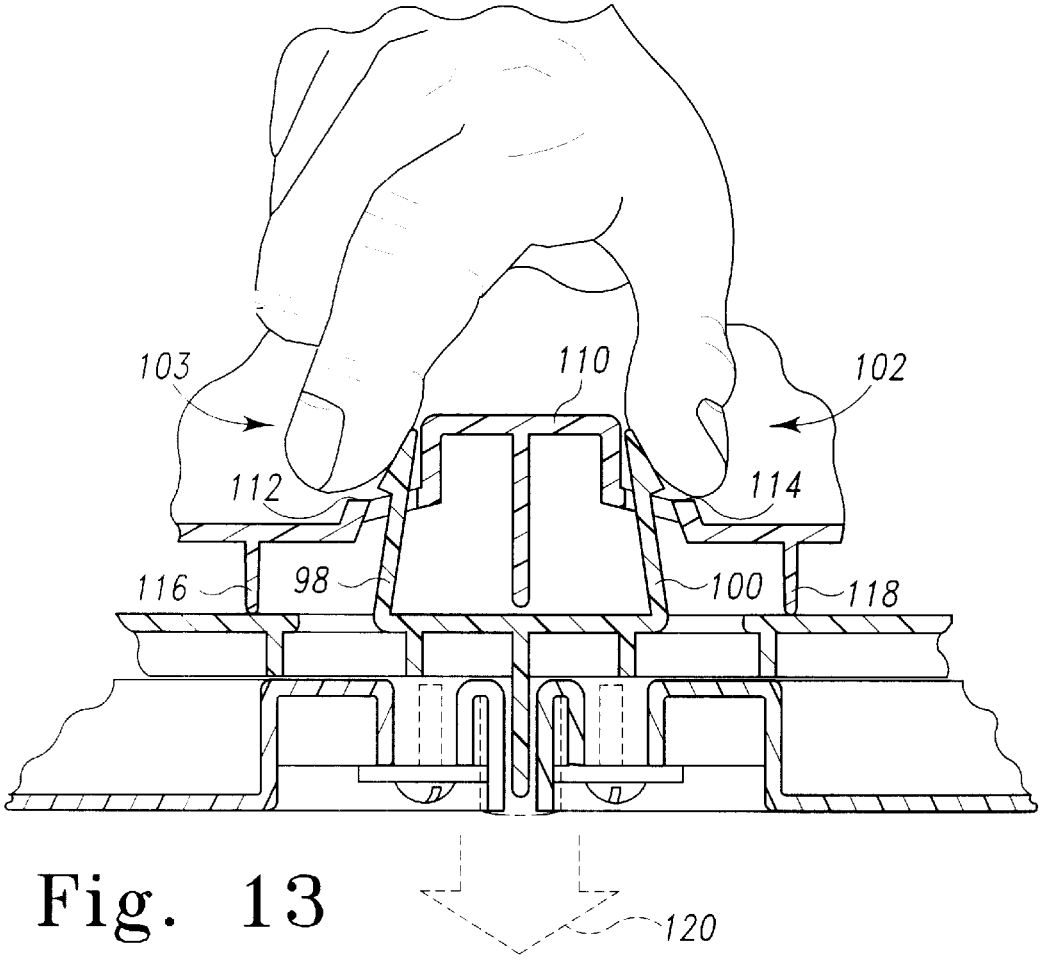
FIG. 13 is a sectional view similar to that of FIG. 12, showing the tabs being disengaged from the edges formed in the fixed tray.
Figure 14:
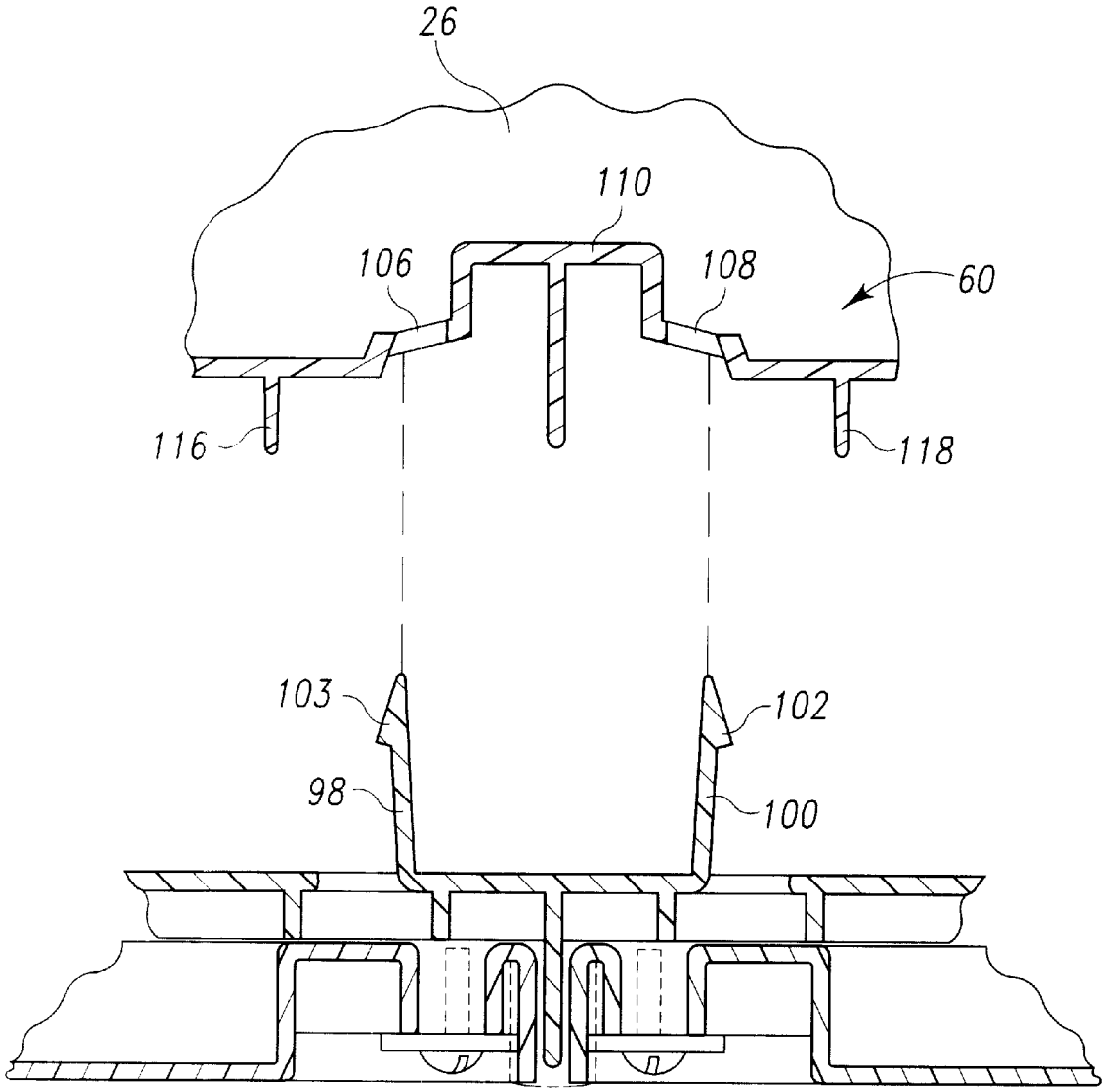
FIG. 14 is a sectional view of the tabs coupled to the movable tray prior to their engagement with edges formed in the fixed tray.

In order to disengage lock 96, finger pressure, as shown in FIG. 13, is applied to tabs 98, 100, directing them toward central island 110. Such pressure releases lips 103, 102 from rims 112, 114, thereby allowing tabs 98, 100 to be pulled back through slots 106, 108 when movable tray 28 is moved toward the closed storage position, and mounting portion 38 of movable tray 28 moves in the direction indicated by arrow 120.

Figure 6:
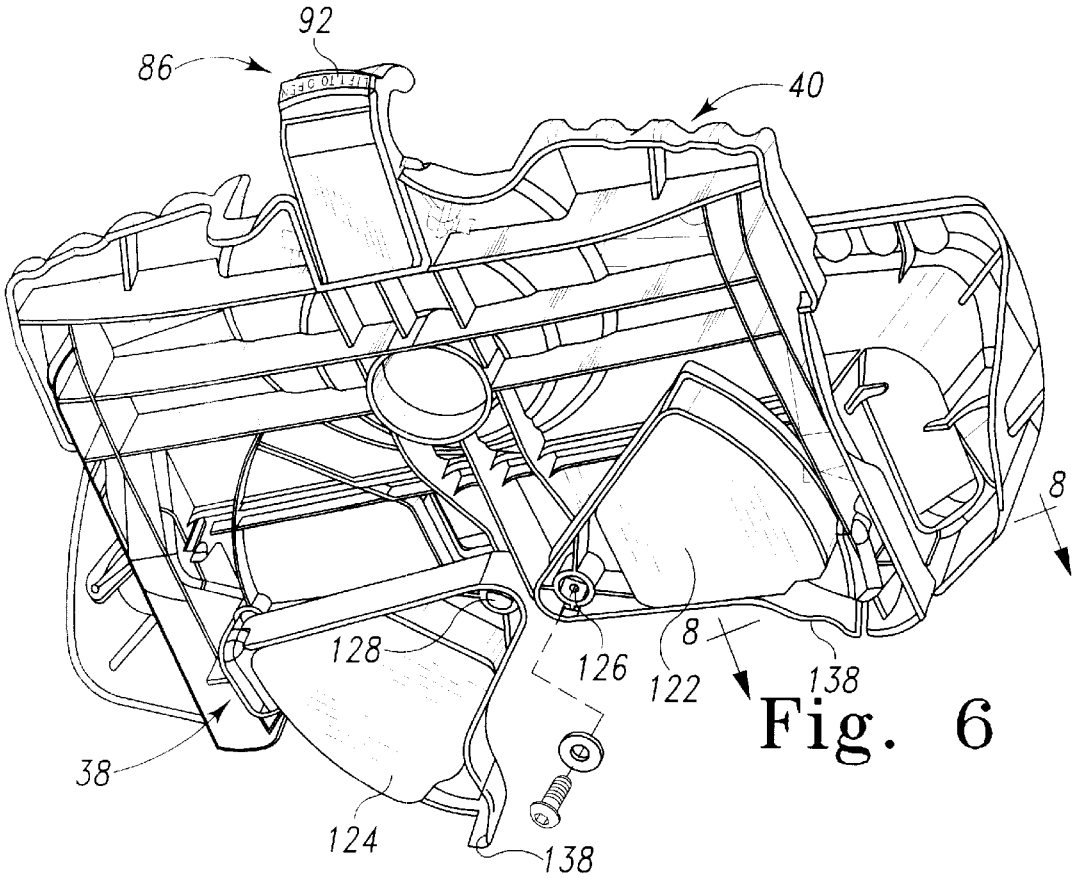
FIG. 6 is a bottom perspective view of the tray assembly of FIG. 5, showing the movable tray in the opened, use position and showing a drawer in the movable tray in a pivotably opened position.
Figure 7:
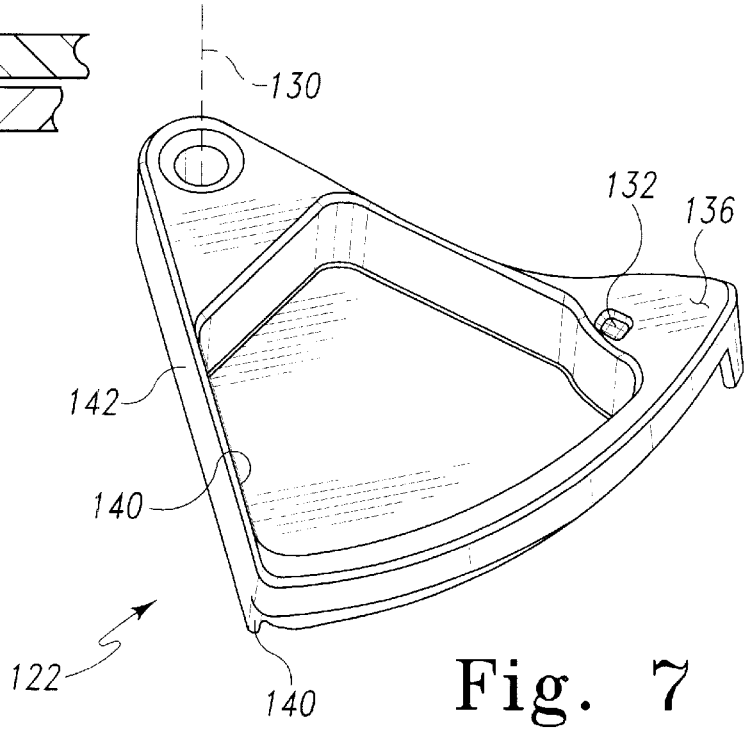
FIG. 7 is a top perspective view of one of the drawers shown in FIG. 6, showing the storage basin, pivot axis, and detent formed to engage a tab and hold the drawer in the closed position.

In the illustrative embodiment, movable tray 28 is further configured to include two drawers 122, 124 formed to be pivotably opened toward a step stool user when the user is standing on one of the steps 18, 20. Drawers 122, 124 move with the movement of movable tray 28. Therefore access is configured to be easiest when movable tray 28 is in the opened use position, as shown in FIG. 1. In such a position, each of drawers 122, 124 pivot about a selected drawer pivot axis 130 formed by fasteners 126, 128, as shown in FIGS. 6 and 7.

Figure 8:
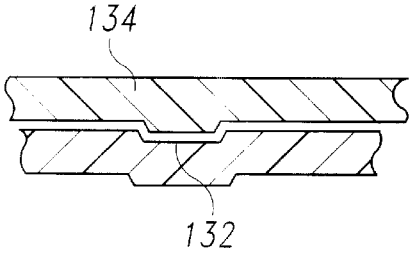
FIG. 8 is a cross sectional view taken along line 8—8 of FIG. 6 showing a tab formed in the movable tray engaging the detent of the drawer shown in FIG. 7.

Drawers 122, 124 engage movable tray 28 and are retained in position under movable tray 28 with a tab and detent system, as shown in FIG. 8. Detent 132 is illustratively formed in top surface 136 of drawer 122, while tab 134 is formed in movable tray 28 such that drawer 122 is retained in the closed position until force is applied by a user.

Drawers 122, 124 further include finger recesses 138 formed to facilitate the movement of drawers 122, 124 by a user between the open and closed position. Additionally, a stopper is used to prevent overextension of drawers 122, 124 from movable tray 28. Illustratively, movable tray 28 includes a tab (not shown) associated with each drawer, the tab contacting an inside surface 140 of rear wall 142 (shown in FIG. 7) of drawers 122, 124 when drawers 122, 124 are extended to the opened position.

Although the invention has been disclosed in detail with reference to certain preferred embodiments, variations and modifications exist within the scope and spirit of the invention as described and defined in the following claims.

What is claimed is:

1. A step stool comprising a frame, steps coupled to the frame, a fixed tray coupled to the frame to lie in a stationary position on the frame, and a movable tray formed to include a foundation portion and a tray portion appended to the foundation portion, the movable tray being coupled to the fixed tray for movement relative to the fixed tray between a use position wherein a substantial portion of the foundation portion of the movable tray lies under a substantial portion of the fixed tray and the tray portion of the movable tray lies away from the fixed tray to expose a top surface of the tray portion and a storage position wherein the tray portion of the movable tray lies alongside the fixed tray to cover the top surface of the tray portion.

2. The step stool of claim 1, wherein the fixed tray includes a mount portion coupled to the frame and arranged to lie above the steps and a shelf portion appended to the mount portion and formed to include a bottom surface facing downwardly toward the steps and a top surface facing upwardly away from the steps and the foundation portion of the movable tray is arranged to lie under and in confronting relation to the bottom surface of the shelf portion of the fixed tray upon movement of the movable tray to assume the use position.

3. The step stool of claim 2, further comprising lock means for releasably locking the foundation portion of the movable tray to the shelf portion of the fixed tray to retain the movable tray in the use position.

4. The step stool of claim 3, wherein the lock means includes a tab receiver formed in the shelf portion of the fixed tray and an upstanding lock tab appended to the foundation portion of the movable tray and arranged to extend into the tab receiver to retain the movable tray in the use position upon movement of the movable tray to the use position.

5. The step stool of claim 3, wherein the shelf portion of the fixed tray includes a left-side basin and a right-side basin and the lock means includes a tab receiver formed in the shelf portion of the fixed tray and located between the left-side and right-side basins and a lock tab appended to the foundation portion of the movable tray and arranged to mate with the tab receiver to retain the movable tray in the use position upon movement of the movable tray to the use position.

6. The step stool of claim 2, wherein the shelf portion of the fixed tray is formed to include a tab receiver passage having a bottom opening formed in the bottom surface and a top opening formed in the top surface and further comprising a lock tab appended to the foundation portion of the movable tray and wherein the lock tab includes an arm arranged to extend through the tab receiver passage to locate a lip appended to the arm in a position located above the top surface and arranged to engage the top surface to block movement of the movable tray from the use,position to the storage position.

7. The step stool of claim 6, wherein the frame includes a first leg, a second leg located in spaced-apart relation to the first leg, and a transverse cross member arranged to extend from the first leg to the second leg, the arm is made of a spring material and anchored to the foundation of the movable tray to move in the tab receiver passage in a direction away from the first leg and toward the second leg to disengage the lip from the top surface of the tray portion of the fixed tray to allow movement of the movable tray from the use position toward the storage position upon application of an external force sufficient to move the arm of the lock tab relative to the foundation of the movable tray and movement of the lock tab out of the tab receiver.

8. The step stool of claim 2, further comprising a drawer arranged to lie under the bottom surface of the shelf portion of the fixed tray and coupled to the shelf portion of the fixed tray for pivotable movement about a pivot axis between a closed position hiding a receptacle formed in the drawer under the shelf portion of the fixed tray and an opened position exposing the receptacle formed in the drawer.

9. The step stool of claim 8, wherein the frame includes a first leg, a second leg located in spaced-apart relation to the first leg, and a transverse cross member arranged to extend from the first leg to the second leg and coupled to the mount portion of the fixed tray, the shelf portion of the fixed tray includes a front face arranged to extend between the first and second legs upon movement of the movable tray to the use position and formed to include a drawer opening, and the drawer includes a front face arranged to lie in the drawer opening formed in the front face of the shelf portion of the fixed tray upon movement of the drawer to the closed position.

10. The step stool of claim 8, wherein the frame includes a first leg, a second leg located in spaced-apart relation to the first leg, and a transverse cross member arranged to extend from the first leg to the second leg and coupled to the shelf portion of the fixed tray, the shelf portion of the fixed tray includes a front face arranged to extend between the first and second legs and formed to include a foundation opening, and the drawer includes a front face arranged to lie in a drawer opening formed in the front face of the shelf portion of the fixed tray and to lie in the foundation opening formed in the front face of the tray portion of the movable tray upon movement of the drawer to the closed position and movement of the movable tray to the use position.

11. The step stool of claim 2, further comprising first and second drawers coupled to the foundation portion of the movable tray for pivotable movement between opened and closed positions and wherein the shelf portion of the fixed tray is formed to include a left-side basin and a right-side basin, the first drawer is arranged to lie under the left-side basin formed in the shelf portion of the fixed tray upon movement of the movable tray to the use position and movement of the first drawer to the closed position, and the second drawer is arranged to lie under the right-side basin formed in the shelf portion of the fixed tray upon movement of the movable tray to the use position and movement of the second drawer to the closed position.

12. The step stool of claim 11, wherein the shelf portion of the fixed tray is formed to include a tab receiver located between the left-side and right-side basins and further comprising a lock tab appended to the foundation portion of the movable tray and arranged to mate with the tab receiver to retain the movable tray in the use position.

13. The step stool of claim 1, wherein the movable tray further includes retainer means for releasably locking the tray portion of the movable tray to the frame to retain the movable tray in the storage position.

14. The step stool of claim 13, wherein the frame includes a first leg, a second leg located in spaced-apart relation to the first leg, and a transverse cross member arranged to extend from the first leg to the second leg and the retainer means is configured to mate with the transverse cross member of the frame upon movement of the movable tray to the storage position.

15. The step stool of claim 14, wherein the retainer means includes a clasp formed to include a frame receiver configured to receive a portion of the transverse cross member of the frame therein and the clasp is mounted on the tray portion of the movable tray for movement about a pivot axis when the movable tray has been moved to assume the storage position from a retained position wherein the clasp is arranged to locate the portion of the transverse cross member of the frame in the frame receiver formed in the clasp to retain the movable tray in the storage position to a released position wherein the clasp is disengaged from the transverse cross member of the frame to allow movement of the movable tray from the storage position to the use position.

16. The step stool of claim 1, wherein the movable tray further includes a retainer mounted for pivotable movement on the tray portion and configured to mate with a portion of the frame upon movement of the movable tray to the storage position to retain the movable tray in the storage position.

17. The step stool of claim 16, wherein the frame includes a first leg, a second leg located in spaced-apart relation to the first leg, and a transverse cross member arranged to extend from the first leg to the second leg and the retainer is configured to mate with the transverse cross member of the frame upon movement of the movable tray to the storage position.

18. A step stool comprising a frame, steps coupled to the frame, a fixed tray coupled to the frame to lie in a fixed position on the frame, a movable tray mounted for pivotable movement on the fixed tray about a pivot axis between a use position away from the fixed tray and a storage position alongside the fixed tray, and a retainer mounted for pivotable movement on the movable tray about a pivot axis and configured to mate with a portion of the frame upon movement of the movable tray to the storage position alongside the fixed tray to retain the movable tray in the storage position.

19. The step stool of claim 18, wherein the frame includes a first leg, a second leg located in spaced-apart relation to the first leg, and a transverse cross member arranged to extend from the first leg to the second leg and the retainer is configured to mate with the transverse cross member of the frame upon movement of the movable tray to the storage position.

20. The step stool of claim 19, further comprising a tray mover appended to the retainer and arranged to engage a mover receiver portion formed on the movable tray during pivotable movement of the retainer away from the transverse cross member and relative to the movable tray to provide handle means for moving the movable tray from the storage position to the use position.

21. The step stool of claims 20, further comprising a tab receiver formed in the fixed tray and a lock tab appended to the movable tray and arranged to extend into the tab receiver to retain the movable tray in the use position upon movement of the movable tray to the use position.

22. The step stool of claim 19, wherein the fixed tray is arranged to cover a first portion of the transverse cross member coupled to the first leg and a second portion of the transverse cross member coupled to the second leg and to expose a middle portion of the transverse cross member arranged to lie between the first and second portions and the retainer is arranged, to mate with the middle portion of the transverse cross member.

23. The step stool of claim 22, wherein the fixed tray is formed to include a finger-receiving opening under the middle portion of the transverse cross member to expose a cylindrical exterior surface of the middle portion of the transverse cross member to provide a carrying handle to allow a user to grip the cylindrical exterior surface when the retainer is moved to disengage the transverse cross member.

24. A step stool comprising a frame, steps coupled to the frame, a fixed tray coupled to the frame to lie in a stationary position on the frame, and a drawer mount mounted for pivotable movement on the frame about a first pivot axis between a horizontal use position and a storage position, a left-side drawer mounted in a left-side chamber formed in the drawer mount for pivotable movement about a second pivot axis relative to the drawer mount between a closed position hiding a receptacle formed in the left-side drawer in the left-side chamber and an opened position exposing the receptacle formed in the left-side drawer, and a right-side drawer mounted in a right-side chamber formed in the drawer mount for pivotable movement about a third pivot axis relative to the drawer mount between a closed position hiding a receptacle formed in the right-side drawer in the right-side chamber and an opened position exposing the receptacle formed in the right-side drawer.

25. The step stool of claim 24, further comprising a tray portion coupled to the drawer mount and arranged to move between a use position away from the frame and a storage position alongside the frame during pivotable movement of the drawer mount relative to the frame about the first pivot axis.

26. The step stool of claim 25, further comprising means for retaining the left-side and right-side drawers in the closed positions during pivotable movement of the drawer mount relative to the frame and upon movement of the tray portion to the storage position.

27. The step stool of claim 24, wherein the second and third pivot axes are parallel to one another and are perpendicular to the first pivot axis.

28. A step stool comprising a frame, steps coupled to the frame, a movable tray coupled to the frame for pivotable movement about a first pivot axis between a horizontal use position wherein a top surface of the movable tray is oriented to lie in a horizontal plane and is exposed to support items thereon and a collapsed storage position alongside the frame to orient the top surface of the movable tray at an angle to the horizontal plane, lock means for releasably locking the movable tray so as to retain the movable tray in the use position, and retainer means for releasably locking the movable tray to the frame to retain the movable tray in the storage position.

29. The step stool of claim 28, wherein the frame includes a first leg and a second leg aligned in spaced-apart parallel relation to the first leg and a shell coupled to the first and second legs and the lock means is configured to lock the movable tray to the shell.

30. The step stool of claim 28, wherein the frame further includes a transverse top member arranged to extend from the first leg to the second leg and the retainer means is configured to lock the movable tray to the transverse top member.

31. The step stool of claim 28, wherein the shell is formed to include a shelf arranged to lie in a fixed position relative to the first and second legs and the lock means is configured to lock the movable tray to the shelf.

32. A step stool comprising a frame having legs movable relative to each other between an opened use position and a collapsed storage position, the frame including an upper portion, a step coupled to the frame, a tray assembly having a fixed tray mounted to the upper portion and a movable tray coupled to the fixed tray for movement relative to the fixed tray, the movable tray having an opened use position and a closed storage position, and further comprising a drawer pivotably coupled o the movable tray.

33. The step stool of claim 32, wherein the movable tray, in its opened position, forms a platform on one side of the fixed tray and the drawer is configured to extend from a closed position underneath the fixed tray to an extended position on an opposite side of the fixed tray.

34. A step stool comprising a frame having legs movable relative to each other between an opened use position and a collapsed storage position, the frame including an upper portion, a step coupled to the frame, a tray assembly having a fixed tray mounted to the upper portion and a movable tray coupled to the fixed tray for movement relative to the fixed tray, the movable tray having an opened use position and a closed storage position, a clasp configured to hold the movable tray in the closed storage position, wherein the clasp is pivotably coupled to the movable tray, and the clasp is configured to pivot to a position where it detachably engages the frame and holds the movable tray in the storage position.

35. The step stool of 34, wherein the frame is configured to have an upper transverse cross member and the fixed tray is configured to form a sleeve around the upper portion of the frame with an opening to expose a central portion of the cross member, the clasp engaging the central portion to hold the movable tray in the storage position.

* * * * *